United States Patent [19]

Adams

[11] 4,056,071

[45] Nov. 1, 1977

[54] COMBINATION PRESSER BAR LIFTERS AND PRESSURE CONTROLS

[75] Inventor: Kenneth Douglas Adams, Madison, N.J.

[73] Assignee: The Singer Company, New York, N.Y.

[21] Appl. No.: 735,304

[22] Filed: Oct. 26, 1976

[51] Int. Cl.[2] ..... D05B 29/02

[52] U.S. Cl. ..... 112/237

[58] Field of Search ..... 112/235, 236, 237, 238, 112/239

[56] References Cited

U.S. PATENT DOCUMENTS

| | | | |
|---|---|---|---|
| 3,473,497 | 10/1969 | Cash | 112/239 |
| 3,669,050 | 6/1972 | Adams | 112/237 |
| 3,793,969 | 2/1974 | Adams | 112/235 |
| 3,815,529 | 6/1974 | Adams et al. | 112/237 X |
| 3,960,098 | 6/1976 | Papajewski et al. | 112/238 |

*Primary Examiner*—George H. Krizmanich

*Attorney, Agent, or Firm*—Edward L. Bell; Robert E. Smith; Edward P. Schmidt

[57] ABSTRACT

A presser device for a sewing machine having a rockable member pivotably carried by the sewing machine frame and connected to a presser bar to axially move the same up or down, a pivoted lever urged by a spring towards the rockable member, and, a drag link carrying a roller on one end, which roller extends between the pivoted lever and one of two surfaces above and below the pivot of the rockable member to urge the presser bar upwardly or downwardly, respectively. Presser bar pressure is varied by varying the spacing between the roller and the pivot of the rockable member. Two embodiments are disclosed, a first wherein the position of the roller is varied by means of a second pivoted lever connected to the drag link; and, a second wherein a pair of push buttons operate on a bell crank connected to the drag link, one of the push buttons incorporating a cam to control movement of the drag link.

8 Claims, 6 Drawing Figures

COMBINATION PRESSER BAR LIFTERS AND PRESSURE CONTROLS

BACKGROUND OF THE INVENTION

The invention is concerned with a presser device for a sewing machine; more specifically with a means for varying the pressure exerted by a presser foot attached to a presser bar, and for lifting the presser foot from contact with a work material.

Generally, in the prior art, a compression spring is used to urge an endwise movable presser bar having a presser foot at one end thereof in contact with a work material, pressing the work material against feeding dogs in the bed of a sewing machine. Variation in the force which the presser foot exerts in pressing the work material against the feeding dogs is accomplished by varying the compression of the compression spring bearing on the presser bar. Increased force is required where the feeding dogs must feed heavy work material, or work material of many plies, or where the sewing machine operates at very high speeds causing the compression spring to "float" due to its own inertia, the result of rapid compressions thereof by the rising feeding dogs. Thus, the force exerted by the presser bar may be quite substantial.

In the usual sewing machine, the presser bar and presser foot attached thereto is brought to an elevated condition in order to remove or introduce work material between the presser foot and the feeding dogs, by means of a lever pivoted on the sewing machine frame and having a cam surface brought into contact with an abutment member fixed to the presser bar. When this lever, which normally projects from a rear surface of the sewing machine, is rotated, the cam surface thereof bears against the abutment member and urges it, and the presser bar to which it is attached, in an upward direction, further compressing the compression spring. In an appropriate circumstance, for example, where many plies of heavy fabric are being stitched at very high speeds, the amount of force required of a machine operator to elevate the presser foot from the work material may well be prohibitive. In other circumstance, where frequent manipulation of the lever is required, it may be found to be excessively tiring.

What is required is a presser device wherein the pressure exerted by a presser foot may be readily varied as required with little or no effect on the ease with which the presser foot may be lifted to an elevated position facilitating removal or insertion of a work material therebeneath.

SUMMARY OF THE INVENTION

The above problem is solved in an arrangement wherein presser foot lifting is accomplished without any appreciable change in compression or extension of the force generating spring, but is accomplished by reversing the moment produced by that spring. Thus a rock lever, pivoted on a rod extending into the sewing machine frame, has an extremity thereof extending into a slot in a presser bar guide block affixed to a presser bar. The rock lever has, on the side of its pivot rod opposite the extremity thereof, a pair of surfaces extending parallel to the pivot rod and towards each other to form the apex of an obtuse angle substantially on a line extending from the extremity through the pivot rod. A loading bar, pivoted on one end relative to the sewing machine frame and spring biased on the other end towards the pair of surfaces on the rock lever, extends across the rock lever approximately equidistant from each of the pair of surfaces. A drag link carries a roller on a stud on one end thereof, the roller impinging selectively on one or the other of the pair of surfaces while a shoulder on the stud engages the loading bar. Means are provided connected to the other end of the drag link to effect selective movement of the drag link to have the roller impinge on one or the other of the pair of surfaces or at any selected point on a given surface. With the roller on the surface below the line extending from the extremity of the rock lever through the pivot rod thereof, a force is exerted by the extremity of the rock lever on the presser bar urging it in a downwardly direction related to the distance of the roller from the pivot rod. With the roller on the surface above the aforementioned line, a force is exerted by the extremity of the rock lever on the presser bar urging it in an upwardly direction to a lifted position of a presser foot attached to the presser bar. Lift of the presser foot is thereby accomplished by reversing the moment produced by the force generating spring with little or no change in force generated thereby.

BRIEF DESCRIPTION OF THE DRAWINGS

In order that the invention may be more fully understood it will now be described, by way of example, with reference to the accompanying drawings in which:

Referring to FIG. 1 there is shown a sewing machine 10 having a bed 12 from which a standard 14 rises to support a bracket arm 15 in overhanging relationship to the bed, the bracket arm terminating in a head end 16. Supported in the head end 16 for lateral oscillation and endwise reciprocation in a manner well known in the sewing machine art is a needle bar 18 to which is affixed a sewing needle 19. Also supported for endwise movement in the head end 16 behind the needle bar 18 is a presser bar 21, to the end of which is affixed a presser foot 22. The presser foot 22 is urged by means of the invention to be described below against feed dogs 23, part of a feed system (not shown) supported within the bed 12 of the sewing machine 10. Also, the needle 19 on the end of the needle bar 18 cooperates with sewing instrumentalities (not shown) supported within the bed 12 of the sewing machine in the formation of sewing stitches.

FIG. 2 is a head end elevation of the sewing machine shown in FIG. 1 with the head end cover 17 and other components therein removed to more clearly show operating elements of the invention. Thus the presser bar 21 slides within a bushing 25 which is affixed by screw 27 to a casing 28, which is itself affixed in the head end 16 of the sewing machine 10 by screws 29. The needle bar 18 reciprocates within bushings supported by a needle bar gate 31. The needle bar gate 31 is pivotably supported within the casing 28 on spherical bushings 33 and 34. Endwise reciprocation of the needle bar 18 and sewing needle 19 is effected from the actuating means of the sewing machine through a latch mechanism 36, and lateral oscilliation of the needle bar and needle is determined from patterning means operating through a driving arm 37 connected to post 38 affixed to the needle bar gate 31 by screw 39.

Figure 1:
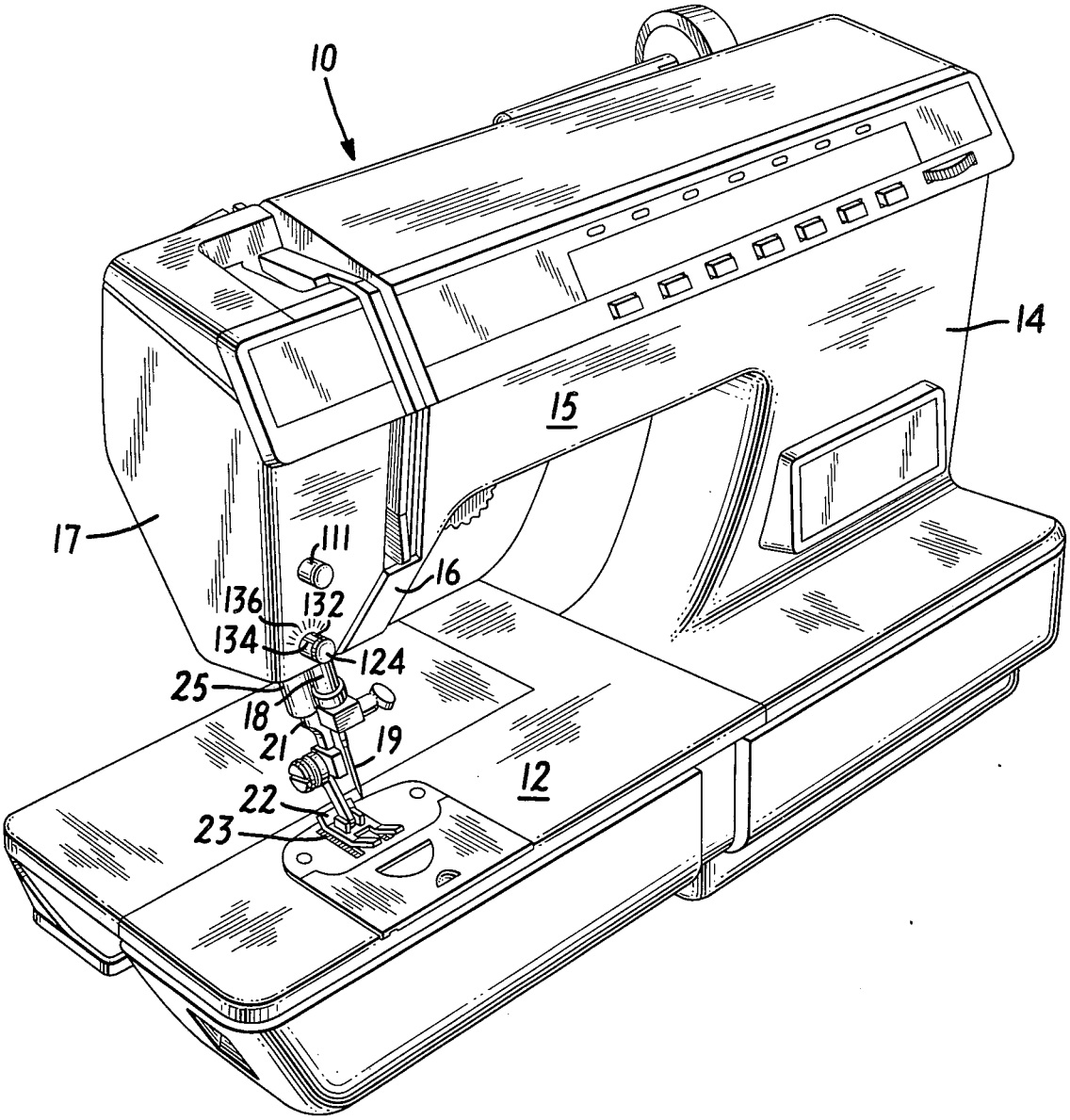
FIG. 1 is a perspective view of a sewing machine in which the invention may be incorporated.

Affixed to the end of the presser bar 21 opposite that end to which the presser foot 22 is affixed is a guide block 42, held thereto by screw 43. An upwardly projecting lug 44 on the guide block 42 is slotted as at 45. A rock lever 48 has an extremity 49 thereof extending into the slot 45 on the guide block 42. The rock lever 48 is attached to a pin 50 extending transversely thereof. The pin 50 extends through a close fitting hole in the casing 28, and serves as a pivot for the rock lever 48. The rock lever 48 is further formed with a pair of surfaces 52, 53 extending perpendicular to the rock lever and parallel to the pivot pin 50, on the end of the rock lever opposite that of the extremity 49. The surfaces 52, 53 extend toward each other to form an obtuse angle having an apex substantially on a line extending from the extremity 49 through the pivot pin 50.

Figure 2:
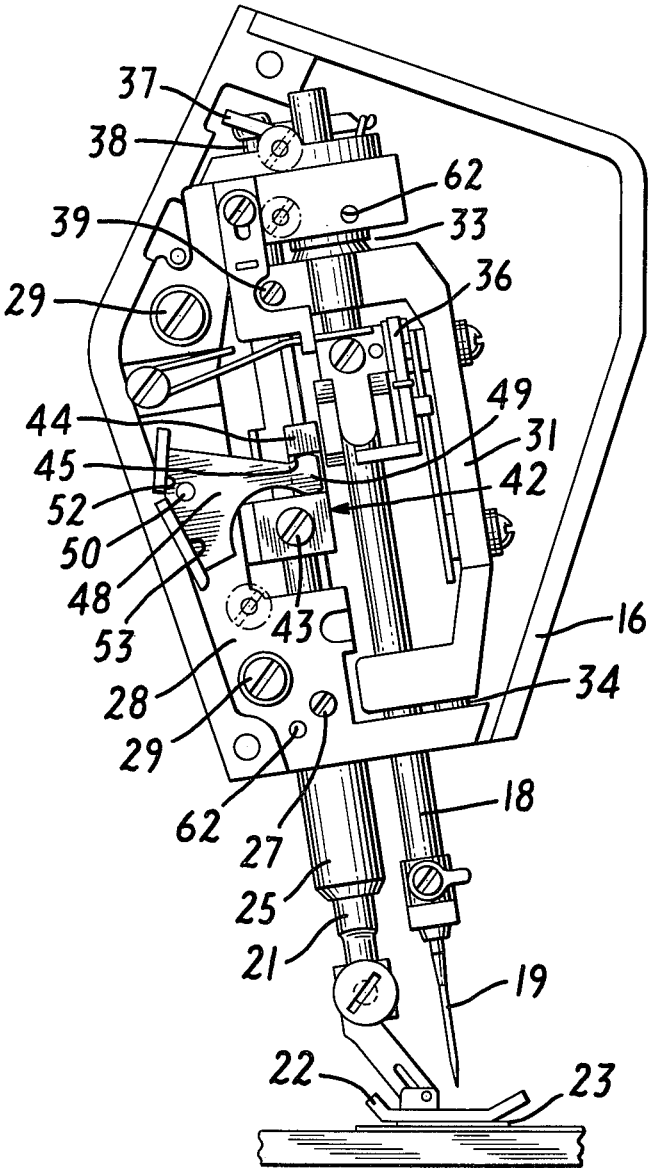
FIG. 2 is a head end elevational view of the sewing machine of FIG. 1 with parts thereof removed to show the relationship of the various parts in the head to the invention.
Figure 3:
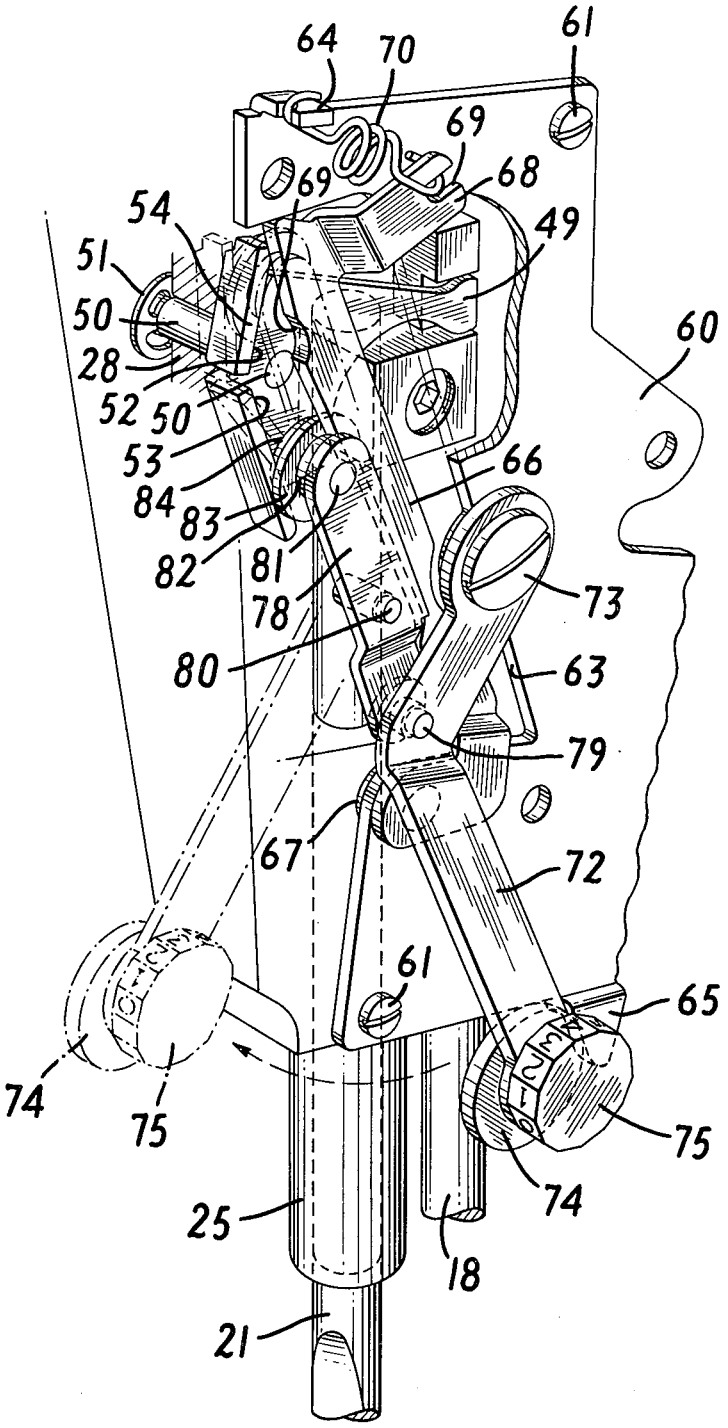
FIG. 3 is a perspective view of one embodiment of the invention installed in the head end of the sewing machine of FIG. 2.

Referring to FIG. 3 there is shown one embodiment of the invention applied to the head end of the sewing machine shown in FIG. 2. The other components of the invention are mounted on a support plate 60 which may be attached to the casing 28 by screws 61 extending into tapped holes 62 in the casing. The support plate 60 is formed with a cutout section 63 into which extends a loading bar 66 pivotably affixed to the support plate by a shouldered rivet 67. The end of loading bar 66 opposite the shouldered rivet 67 is formed with a transverse extension 68 notched on the end to receive one end of an extension spring 70, the other end of which is affixed to a lug 64 extending from the top of the support plate 60. An adjusting bar 72 is pivotably attached to the support plate 60 by shouldered screw 73. A drag link 78 has one end thereof pivoted on a shouldered rivet 79 attached to the adjusting bar 72. The drag link 78 for most of its length extends immediately adjacent the side of the loading bar 66. On the other end of the drag link 78 there is affixed a stud 81 having a shouldered section 82 which bears against the edge of the loading bar 66, a flange portion 83 which extends on the other side of the loading bar 66 and effectively traps the loading bar between the drag link and the flange, and a stud end which supports a roller 84 designed for movement along the surfaces 52 and 53 of the rock lever 48. The flange portion 83 of the stud 81 also lies adjacent the edges 54 of the surfaces 52, 53 of the rock lever 48. The roller 84 may be held on the stud 81 by any suitable means such as a snap ring (not shown).

Thus, as is shown in FIG. 3, connection is established between the loading bar 66, which is urged by the extension spring 70 in a counter-clockwise direction and the shouldered rivet 67, and the rock lever 48 through the agency of the stud 81, having a shouldered section 82 impinging on the loading bar and supporting roller 84 thereon in contact with surface 53 or surface 54, of the rock lever. When the roller 84 impinges on the surface 53 below the pivot pin 50 supporting the rock lever 48, the rock lever will be urged into a clockwise direction as viewed in FIG. 3. Thus the force exerted by the extension spring 70 is converted, by moments exerted on the loading bar 66 and the rock lever 48, into a force exerted by the extremity 49 of the rock lever, urging the presser bar 21 downwardly. As is shown in phantom in FIG. 3, the adjusting bar 72 may be rotated to the rear of the sewing machine 10, causing the drag link 78 to move upwardly and carry the stud 81 and roller 84 supported thereon into contact with the surface 52 of the rock lever 48. With the adjusting bar 72 and the roller 84 in the positions shown in phantom in FIG. 3, the roller 84 impinges on the surface 52 of the rock lever 48, the force of the extension spring 70 exerts a counter-clockwise moment on the rock lever thereby urging the extremity 49 of the rock lever to move upwardly resulting in disengagement of the presser foot 22 from a work material or disengagement with the feed dogs 23. There is also shown in this embodiment a stop 65 on the lower edge of the support plate 60, which stop is engaged by the periphery of a circular disc 74 eccentrically supported on the free end of the adjusting bar 72 and rotatable by means of dial 75 to a selected position. As the dial 75 is rotated, and thereby also the circular disc 74, the abutment of the periphery of the eccentrically supported circular disc against the stop 65 of the support plate 60 will cause the angular position of the adjusting bar 72 to change, with a resulting change in the position of the drag link 78, stud 81 and roller 84 supported thereon. By this expedient the position of the roller 84 on the surface 53 may be varied to vary the moment about the pivot pin 50 and the resulting force exerted by the extremity 49 of the rock lever 48 on the presser bar 21. The loading bar 66 as shown in FIG. 3 is formed with a groove 69 in the edge thereof which may be used, for example, to establish a position for darning wherein the center of the stud 81 and roller 84 is located substantially along the line joining the extremity 49 of the rock lever 48, the center of the pivot pin 50, and the apex of the obtuse angle formed by the surfaces 52, 53 of the rock lever. It is evident that similar grooves may be provided elsewhere on the edge of the loading bar 66 to establish positions for frequently used settings of presser bar pressure. In order to prevent movement of the adjusting bar 72 to such an extreme that the roller 84 will pass over the upper edge of the upper surface 52, a stop 80 is affixed to the drag link 78 and will impinge on the rock lever 48 to provide a stop against excess upward motion of the drag link.

Figure 6:
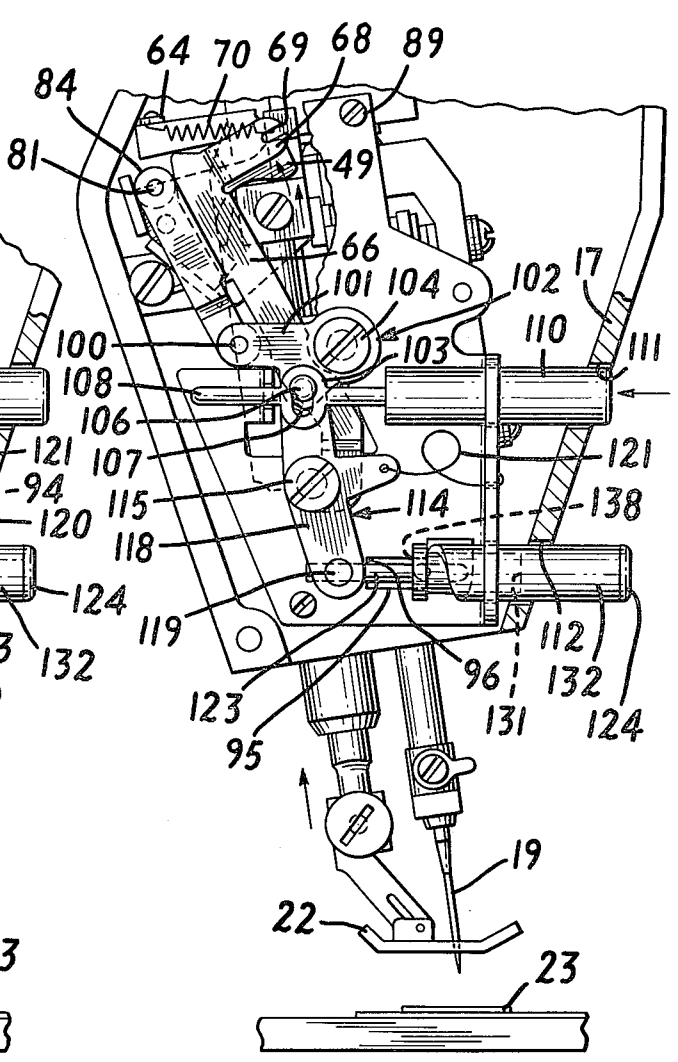
Figure 5:
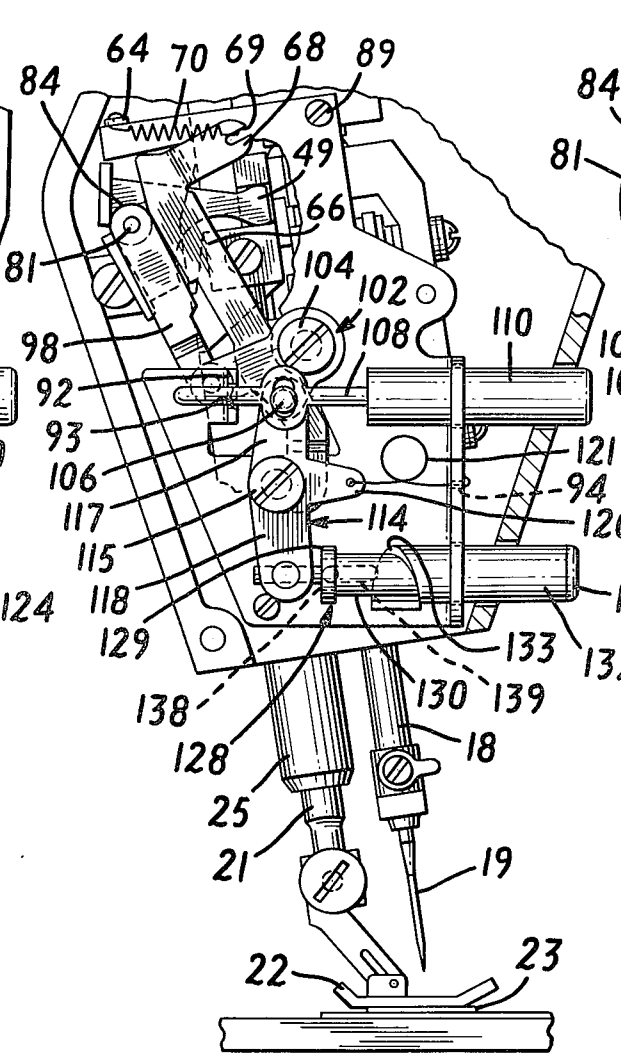
FIG. 5 is a view similar to FIG. 4 showing the minimum presser bar pressure position; and, FIG. 6 is a view similar to FIGS. 4 and 5 showing the various components of the second embodiment of the invention in a position to elevate the presser foot.
Figure 4:
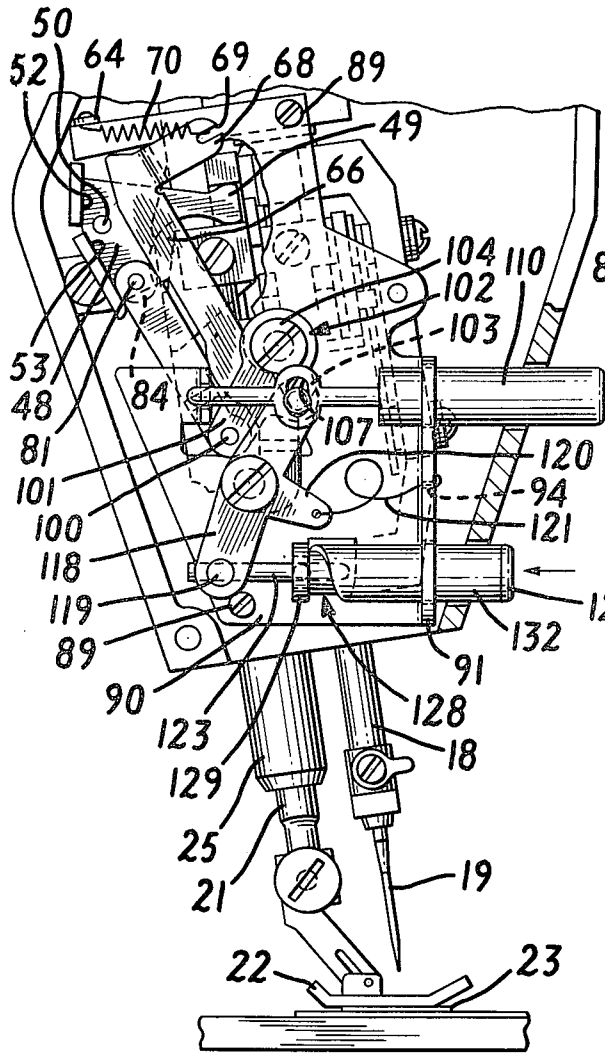
FIG. 4 is a head end elevational view of a sewing machine similar to that shown in FIG. 2, with, however, a second embodiment of the invention shown in the maximum presser bar pressure position.

There is shown in FIGS. 4, 5, and 6 a second embodiment of the invention operable by push button means. The rock lever 48, attached to pin 50 on which it pivots, is identical to that shown in the first embodiment, however it may be shifted to another location on the casing 28 to operate with linkage of this second embodiment. The loading bar 66 and extension spring 70 are similar to the first embodiment, and connected in this embodiment to a modified support plate 90. The support plate 90 is attached by screws 89 to the casing 28, and is modified, in part, by the inclusion of a laterally extending ear 91. As in the previous embodiment a drag link 98 is provided having a roller 84 supported on a stud 81 on one end thereof. The other end of the drag link 98 is freely pivoted on a shouldered rivet 100 attached to a first arm 101 of a bell crank 102 pivoted on a shouldered screw 104 connected to the support plate 90. A second arm 103 of the bell crank 102 supports a post 106 which extends through a vertical slot 107 in an enlarged section of a guide rod 108 in a scotch-yoke arrangement. A free end of the guide rod 108 is supported in a slot 93 of a transverse ear 92 of the support plate 90. The other end of the guide rod 108 is carried by and attached to a push button 110, which itself extends through an opening in the laterally extending ear 91 of the support plate 90 and an opening 111 provided therefor in the head end cover 17. Thus when the push button 110 is actuated, the guide rod 108, by means of the vertical movement accomodating slot 107 about the post 106, rotates the bell crank 102, the vertical motion of the post being accomodated by the slot.

The support plate 90 also carries a three-armed lever 114 rotatable about shouldered screw 115 affixed to the plate. A upper arm 117 of the three-armed lever 114 is slotted to accomodate the post 106 and is situated behind the guide rod 108 in the figures of this embodiment. The slot in the upper arm 117 of the three-armed lever 114 accomodates to vertical motion of the post 106 when the bell crank 102 is rotated. A lower arm 118 of the three-armed lever 114 carries at its lower extremity a bushing 119 freely rotatable therein. A rod 123 terminates at the bushing 119 and is attached thereto. From the bushing 119, the rod 123 extends through a cam follower and guide piece 128, which is coaxial with and extendable into a cavity 131 in a cam push button 132. The rod 123 terminates in a head 124 on the opposite side of the cam push button 132. The cam push button 132 is carried in an opening in the laterally extending ear 91 of the support plate 90 and extends through an opening 112 in the head end cover 17, and supports the cam follower and guide piece 128. A third arm 120 of the three-armed lever 114 extends forwardly of the upper arm 117 and lower arm 118 thereof and supports at its extremity one end of an over-center spring 121, the other end of which extends through an opening 94 in the laterally extending ear 91 of the support plate 90.

The cam follower and guide piece 128 is formed with a collar 129 on one end of a body 130 which extends into and is supported by the cavity 131 in a cam dial 132. A boss 138 formed as part of the collar 129 on the cam follower and guide piece 128 extends through a slot 95 in the support plate 90 (see FIG. 6), the extension of the boss into the slot serving to prevent the cam follower and guide piece 128 from rotating when the cam dial 132 is rotated and to provide stops for cam dial and guide piece motion. The cam follower and guide piece 128 is also fashioned with a cam follower 139 projecting out from the body 130. The cam follower 139 on the cam follower and guide piece 128 abuts a cam 133 formed on the face of the cam dial 132 surrounding the body 130 of the guide piece. Thus the cam dial 132 and the guide piece 128 form an extensible arrangement which is supported on the rod 123 and abuts the head 124 of the rod thereby to control the amount of the rod 123 which extends beyond the arrangement. As was stated above, the rod 123 is affixed to the bushing 119, which is rotatable in the lower arm 118 of the three-armed lever 114. Where the cam dial 132 and guide piece 128 are arranged to permit a large expanse of the rod 123 to protrude beyond the guide piece as is shown in FIG. 4, the over-center spring will exert a force on the three-armed lever 114, tending to rotate the three-armed lever to its most clockwise position as determined by the abutment of the boss 138 on the collar 129 of the guide piece with the innermost wall 96 of the slot 95 (see also FIG. 6). As is shown in FIG. 5 when the cam dial 132 and guide piece 128 are arranged to provide the least extension of the rod 123 from the guide piece, the abutment of the boss 138 on the collar 129 of the guide piece against the slot wall 96 results in a substantially different position of the three-armed lever 114. It is evident that rotation of the cam dial 132 to positions intermediate to that shown in FIGS. 4 and 5 will result in corresponding intermediate positions of the three-armed lever 114. It is also evident from an inspection of FIG. 6 that depression of push button 110 acting on the post 106 affixed to the second arm 103 of the bell crank 102 will cause the bell crank to rotate clockwise and the three-armed lever 114 to rotate counter-clockwise to where the boss 138 on the collar 129 of the guide piece 128 will impinge on the wall of the slot 95 opposite the wall 96. The push button 110 will remain in this position under the influence of the over-center spring 121 until the cam dial 132 is depressed to overcome the influence of the spring.

Referring again to FIG. 4, the various components of the second embodiment of the invention are shown in a position to exert the greatest force on the presser bar 21 and presser foot 22. The cam dial 132 has been rotated relative to the cam follower and guide piece 128 to permit the greatest extension of the rod 123 from the guide piece. With the cam dial 132 depressed to an active position the three-armed lever 114 is rotated to its most clockwise position, and is retained there by the over-center spring 121. The slot in the upper arm 117 of the three-armed lever 114 which encircles the post 106 affixed to the second arm 103 of the bell crank 102, has rotated the bell crank to a most counter-clockwise position. The first arm 101 of the bell crank 102 which is connected to the lower end of drag link 98 by shouldered rivet 100, has drawn the drag link and the roller 84 revolving on stud 81 affixed to the upper end of the drag link, to a lowermost position. In this position the roller 84 impinges on the lowermost portion of the surface 53 of the rock lever 48. As in the previous embodiment the loading bar 66, which is pivoted to the support plate 90, is urged by the extension spring 70 in a counter-clockwise direction. The loading bar 66 impinges on a shouldered section 82 of the stud 81 exerting a force on the stud and on roller 84 supported thereon which by virtue of its connection with the lowermost portion of the surface 53 of rock lever 48, furtherest from the pivot pin 50, creates a clockwise moment on the rock lever about the pivot pin. Thus the extremity 49 of the rock lever 48 exerts its greatest force on the pressure bar 21 urging the presser foot 22 against the feed dogs 23.

Referring to FIG. 5, the cam dial 132 has been rotated relative to the cam follower and guide piece 128 to provide the least extension of the rod 123 beyond the guide piece. By virtue of the connection of the rod 123 to the bushing 119 rotatable in the lower arm 118 of the three-armed lever 114, the three-armed lever has been rotated counter-clockwise of the position shown in FIG. 4. The over-center spring 121 is depicted in a position close to its over-center point, but still retains the three-armed lever in a position determined by the boss 138 of the collar 129 of the guide piece 128 seated against the wall 96 of the slot 95 in the support plate 90. The bell crank 102 has been rotated clockwise, the first arm 101 thereof urging the drag link 98 and the roller 84 rotatable on stud 81 affixed to one end thereof to a position on the surface 53 of the rock lever 48 close to the pivot pin 50. In this position the moment exerted by the rock lever 48 is a minimum and the force transfered from the extremity 49 of the rock lever to the presser bar 21 is also, therefor, at a minimum.

Rotation of the cam dial 132 to positions intermediate that shown in FIGS. 4 and 6 will result in intermediate positions of the three-armed lever 114 and, therefor, intermediate positions of the roller 84 on the surface 53 of the rock lever 48. The moment exerted by the rock lever 48 would be intermediate to that exerted in FIGS. 4 and 6, as would be the force transferred from the extremity 49 of the rock lever to the presser bar 21.

Referring to FIG. 6, the condition achieved when the pushbutton 110 is depressed is shown. The guide rod 108 attached to the pushbutton 110 and the vertical slot 107 in the guide rod have moved inwardly. The post 106 on the second arm 103 of the bell crank 102 which extends through the vertical slot 107 in the guide rod 108 rotates the bell crank in a clockwise direction, moving the drag link 98 and the roller 84 carried by the stud 81 on the upper extremity of the drag link to an uppermost position on surface 52 of the rock lever 48. The location of the roller 84 above the pivot pin 51 of the rock lever 48 has caused the force transferred from the loading bar 66 to urge the rock lever in a counter-clockwise direction. The upper edge of the loading bar 66 may be relieved, as is shown, to alleviate undue extension of spring 70. The upward motion of the extremity 49 of the rock lever 48 extending in the slot 45 of the guide block 42 supported on the presser bar 21, has caused the presser bar to elevate the presser foot 22 to a position out of contact with the feeding dog 23 or work material supported thereon. The over-center spring 121 has moved to an over-center position and urged the three-armed lever 114 to a counter-clockwise position, retaining the presser bar 21 and presser foot 22 attached thereto in an elevated position. Movement of the presser bar 21 and presser foot 22 attached thereto to a lowermost active state may be accomplished from this position by depression of the head 124 of rod 123 extending through the cam dial 132. In this figure the cam dial 132 and cam follower and guide piece 128 are shown in a position to obtain the most extension of the rod 123 from the guide piece resulting in maximum presser foot pressure if the head 124 is depressed. In this view, the slot 95 in the support plate 90 with the slot wall 96 providing a stop to the boss 138 on the collar 129 of the cam follower and guide piece 128 is most apparent. An inspection of FIGS. 4, 5 and 6 will indicate the flexibility given to the design by the drag link 98. The use of a drag link 98 provides a degree of isolation of the roller 84 from the bell crank 102, thereby minimizing the effect of hurdles or of varying thicknesses of material.

Setting of presser bar pressure may be most readily obtained after the push button 110 is depressed. The cam dial 132 may be inscribed with an axially aligned mark 134 on its outer periphery (See FIG. 1), and the cam dial may be rotated to a selected position in which the mark is aligned with a selected indicia 136 inscribed on the head end cover 17 about the opening 112 therein. The cam dial 132 and head 124 of the rod 123 may then be depressed to lower the presser foot 22 to in contact with a work material.

There have been disclosed two embodiments of a presser device for a sewing machine, each having a rock lever 48 connected to the presser bar 21, wherein the pressure exerted by the rock lever urging the presser bar in contact with a work material or elevating the presser bar is effected by varying the position of a roller 84 interposed between the rock lever and a pressure means adjacent the rock lever. Each embodiment discloses a different means for varying the position of the roller. It will be apparent to one skilled in the art that the obtuse angle formed by the apex of the surfaces 52, 53 of the rock lever 48 may be altered to provide the range of pressure required on the presser foot 22 through altered extension of spring 70. The surfaces 52, 53 of the rock lever 48 may also be contoured in order to obtain a tailored pressure of the presser foot 22 against a work material. Thus, for example, the variation in force transferred by the loading bar 66 as the shouldered section 82 of the stud 81 moves up the loading bar thereby increasing the moment arm, may be compensated for by contouring the surface 53 to increase the extension in the spring 70 a small amount along with this movement.

The loading bar 66, pivoted relative to the sewing machine frame on a shouldered rivet 67, is given a constant counter-clockwise moment by the force exerted on the extension 66 thereof, by the extension spring 70. The shouldered section 82 of the stud 81, affixed to the upper end of drag link 78 or 98, impinges on the loading bar 66 at a selected position to transfer a force from the loading bar to a selected point on the surface 53 of the rock lever 48, or to surface 52 thereof, by way of roller 84, also supported on stud 81. The force transferred will vary with the distance from the shouldered rivet 67 on which the loading bar 66 is pivoted, and to minimize the difference the length of the loading bar is made a substantial multiple of the length of the surface 53 of the rock lever 48. The force transferred to the surface 53 of the rock lever 48 by way of the roller 84 is converted to a clockwise moment of the rock lever about the pivot pin 50 thereof, related to the distance of the roller from the pivot pin, as adjusted by manipulation of the drag link 78 or 98. The clockwise moment of the rock lever 48 results in a downwardly force exerted by the extremity 49 of the rock lever on the slot 45 of the guide block 42 affixed to the presser bar 21. Movement of the roller 84 to the surface 52 of the rock lever 48 reverses the moment of the rock lever 48 to a counter-clockwise moment resulting in an upward force exerted on the slot 45, with little or no additional force generated by the spring 70, or other resistance to such a movement other than that generated by friction of the various components of the presser device.

In the embodiments disclosed, the rock lever 48 is formed with a pair of surfaces 52, 53 extending parallel to the pivot pin 50 for the rock lever, which surfaces intersect to form an obtuse angle having its apex along a straight line extending from the extremity 49 of the rock lever through the pivot pin thereof to the apex. As indicated above the obtuse angle, formed by the intersection of the surfaces 52, 53 of the rock lever 48, may be made larger or smaller to provide the range of pressure required on the presser foot 22. Indeed, the surfaces 52, 53 of the rock lever 48 may be implemented by one plane surface extending partially above and partially below the pivot pin 50 of the rock lever, where the loading bar 66 is made a substantial multiple of the length of the plane surface. In this latter case, the force imparted to the shoulder section 82 of the stud 81 fixed to the drag link 78 changes more gradually, by virtue of the length of the loading bar 66, than the moment arm from the pivot pin 50 to the point of contact of the roller 84, supported on stud 81, with the plane surface; resulting in an increasing counter-clockwise moment on the rock lever 48 as the shoulder section of the stud is moved towards the shouldered rivet 67 on which the loading bar is pivoted.

The obtuse angle, formed by the intersection of the surfaces 52, 53 of the rock lever 48, opens towards the loading bar 66. In the embodiments disclosed, the apex of the obtuse angle is situated on one side of the pivot pin 50 of rock lever 48, and the extremity 49 of the rock lever is located on the other side of the pivot pin. Other arrangements will suggest themselves to those skilled in the art, such as an arrangement where the surfaces 52, 53 of the rock lever 48 are situate between the pivot pin 50 and the extremity 49, forming an obtuse angle opening towards the pivot pin, and with the loading bar 66 extending across the rock lever rearwardly of the surfaces. It is not required that the extremity 49 of the rock lever 48 be aligned with the pivot pin 50 thereof and the apex of the obtuse angle. It is only required that a moment be imparted thereto. Thus the extremity 49 of the rock lever 48 may be an extension of the surface 53 thereof or any other arrangement of the rock lever 48 which may exert a moment. Thus, the invention is capable of a high degree of flexibility which may be adapted to use in a wide variety of sewing machines.

Having thus set forth the nature of the invention what is sought to be claimed is:

1. A presser device for a sewing machine having a frame, said presser device comprising: a presser bar supported by said frame for endwise movement; rockable means operatively connected to said presser bar for transfering selectively variable and reversible force thereto; means for creating a force for transfer to said presser bar; and, means for adjustably connecting said force creating means to said rockable means in order to obtain said variable and reversible force on said presser bar.

2. A presser device for a sewing machine having a frame; said presser device comprising: a presser bar supported by said frame for endwise movement toward and away from a work material; a member having an axis pivoted on said sewing machine frame, said member having a lug extending transversely of said pivot axis and operatively connected to said presser bar, said member being further formed with a surface extending parallel to said pivot axis; means for creating a force; means for connecting said force creating means to said surface at selectively variable distances from said pivot axis.

3. A presser device for a sewing machine having a frame; said presser device comprising: a presser bar supported by said frame for endwise movement toward and away from a work material; a member having an axis pivoted on said sewing machine frame, said member having a lug extending transversely of said pivot axis and operatively connected to said presser bar, said member being further formed with a pair of surfaces extending parallel to said pivot axis, said surfaces extending towards each other to form an obtuse angle; means for creating a force; means for connecting said force creating means to a selected surface of said surfaces a selectively variable distance from said pivot axis.

4. A presser device for a sewing machine having a frame; said presser device comprising: a presser bar supported by said frame for endwise movement toward and away from a work material; a member having an axis pivoted on said sewing machine frame; said member having a lug extending transversely of said pivot axis and operatively connected to said presser bar, said member being further formed with a pair of surfaces extending parallel to said pivot axis, said surfaces extending towards each other to form an obtuse angle opening toward said pivot axis; means for creating a force; means for connecting said force creating means to a selected surfaces of said surfaces a selectively variable distance from said pivot axis.

5. A presser device as claimed in claim 4 wherein said force creating means includes a bar at least as long as said pair of surfaces of said member and pivotably supported on one end to extend adjacent both surfaces, and resilient means for urging said bar towards said surfaces.

6. A presser device as claimed in claim 5 wherein said connecting means includes a link having a stud attached to one end thereof, said stud having a portion thereof slidable on said bar; a roller carried by said stud adjacent said slidable portion, said roller impinging on a selected part of a selected surface of said pair of surfaces; and, means for positioning said link to place said roller on a selected part of a selected surface of said pair of surfaces.

7. A presser device as claimed in claim 6 wherein said means for positioning said link includes a lever pivoted on one end relative to the sewing machine frame, the other end of said link having a pivotable connection to said lever along its length; an eccentric pivotably supported on the other end of said lever; operator manipulating means connected to said eccentric; and stop means supported by said frame and engageable by said eccentric when said roller impinges on a selected surface of said pair of surfaces associated with said endwise movement of said presser bar towards a work material.

8. A presser device as claimed in claim 6 wherein said means for positioning said link includes a bell crank supported by said frame and having one arm pivotably connected to the other end of said link, a centrally pivoted lever supported by said frame and having one end shiftably connected to a second arm of said bell crank, a push button supported by said frame and having a shiftable connection to said one end of said lever and to said second arm of said bell crank, and, a push button supported by said frame and having selectively extensible means shiftably connected to the other end of said lever.

* * * * *